US006669911B1

(12) United States Patent
Swanson

(10) Patent No.: US 6,669,911 B1
(45) Date of Patent: Dec. 30, 2003

(54) FRAME FOR MULTIWELL TRAY

(76) Inventor: David W. Swanson, 3241 Sunset Dr., Fallbrook, CA (US) 92028

( * ) Notice: Subject to any disclaimer, the term of this patent is extended or adjusted under 35 U.S.C. 154(b) by 294 days.

(21) Appl. No.: 09/773,237

(22) Filed: Jan. 31, 2001

(51) Int. Cl.[7] ..... B01L 3/00

(52) U.S. Cl. ..... 422/102; 422/99; 422/942; 435/287.8; 435/288.2; 435/288.4

(58) Field of Search ..... 422/99, 101, 102, 422/940–942; 435/283.1, 287.8, 288.3, 288.4

(56) References Cited

U.S. PATENT DOCUMENTS 4,478,094 A 10/1984 Saloman et al. ..... 73/863.32
4,799,599 A * 1/1989 Hermann ..... 215/307
5,084,246 A * 1/1992 Lyman et al. ..... 422/101
5,516,490 A * 5/1996 Sanadi ..... 422/101
5,741,463 A * 4/1998 Sanadi ..... 422/101
5,916,526 A * 6/1999 Robbins ..... 422/102
5,950,832 A * 9/1999 Perlman ..... 206/446
D420,743 S 2/2000 Monks ..... D24/224
6,251,343 B1 * 6/2001 Dubrow et al. ..... 422/102
6,277,630 B1 * 8/2001 Brophy et al. ..... 435/288.4
6,315,957 B1 * 11/2001 Feygin et al. ..... 422/101
6,340,589 B1 * 1/2002 Turner et al. ..... 435/287.2

* cited by examiner

*Primary Examiner*—Jill Warden
*Assistant Examiner*—Dwayne K Handy
(74) *Attorney, Agent, or Firm*—Mary Jo Redman; Calif Tervo

(57) ABSTRACT

Rigid frame (10) for holding thin, flexible tray top (82) of injection-molded multiwell tray (81) planar. Multiwell tray (81), such as a titre or PCR plate, includes apertures (86) spaced apart in peripheral wall (85). Frame wall (20) of frame (10) includes a plurality of barbs (41) spaced apart on interior surface (40). Apertures (86) and barbs (41) cooperate to retain tray (81) within tray (10).

23 Claims, 1 Drawing Sheet

FIG. 1
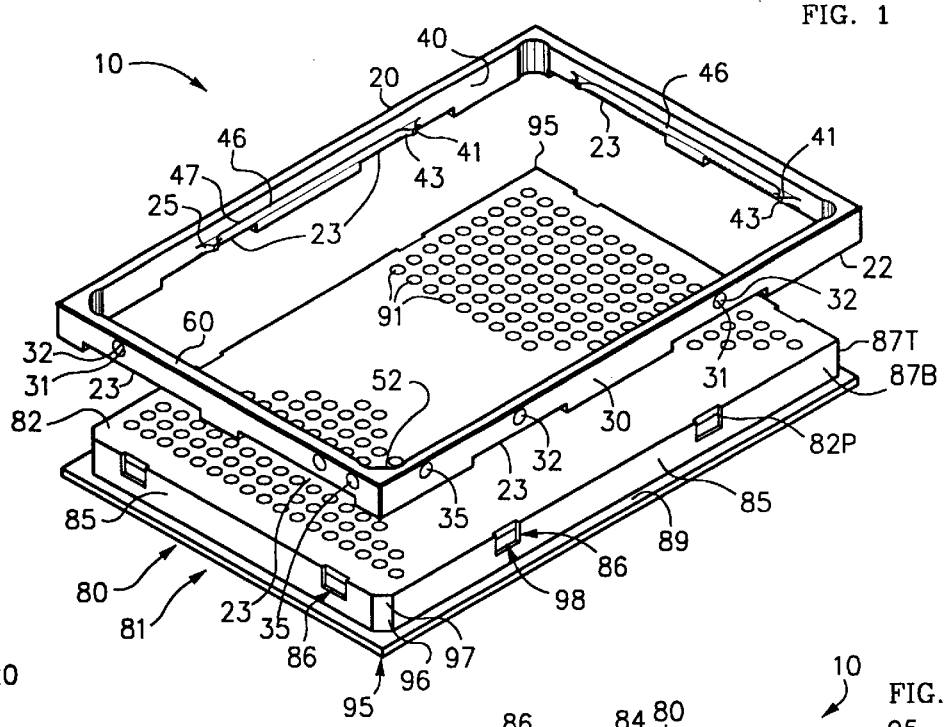
FIG. 2
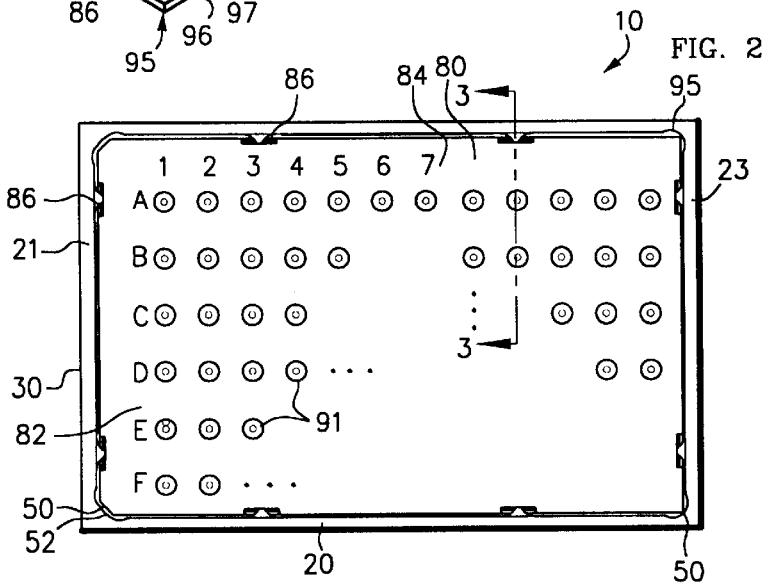
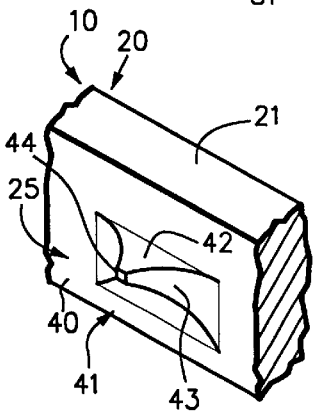
FIG. 4
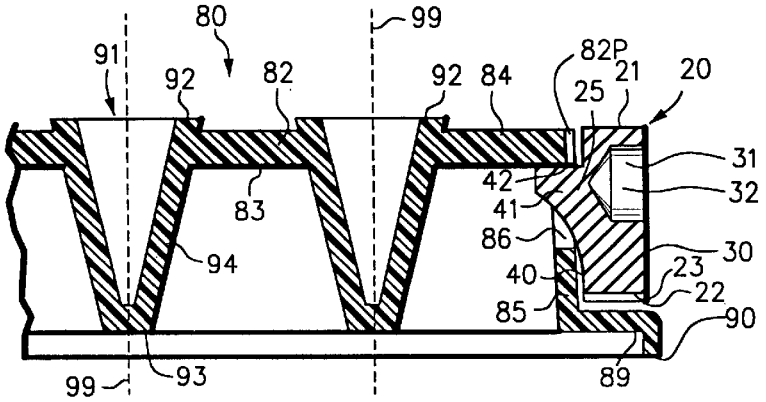
FIG. 3

FRAME FOR MULTIWELL TRAY

FIELD OF THE INVENTION

This invention relates to multiwell trays or titre plates used as containers for chemical or biochemical reactions, such as for polymerase chain reaction (PCR) and more particularly, to a rigid frame for holding a plastic PCR plate planar.

BACKGROUND OF THE INVENTION

Molecular biological reactions are often carried out in trays, or titre plates, containing an array of wells. The polymerase chain reaction (PCR) is one such reaction. In it, tiny quantities of materials are processed through a long sequence of steps, including being heated with a heater block. Multiwell trays increase throughput by allowing many reactions to be performed at one time.

PCR has become such a routine procedure that cutting the cost of the apparatus by even small increments is important. Wells can be machined out of a rigid slab of material to form a multiwell plate, but injection molding has been found to produce a somewhat acceptable, and cheaper, plate. U.S. Des. Pat. No. D420,743 (Monks) is exemplary of plastic injection-molded trays.

The various liquid reactants can be individually inserted into each well by a hand-operated micropipettor. Typically, though, an automated dispenser performs this repetitive operation. Salomon et al. disclose (U.S. Pat. No. 4,478,094) such a dispenser. The Salomon apparatus has a row of dispensing tips that fill an entire row of wells on a tray. Other liquid dispensers have tips arranged in a matrix, which may be large enough to fill all the wells on a tray with one dispense cycle.

Ganged dispensers require that the trays have consistent dimensions and be planar. The longitudinal axes of the wells must be paraller to the direction of travel of the dispenser head, otherwise the dispensing tips may miss one or more of the wells, or jam against the walls of some of the wells such that the tray is picked up by the tips as the dispensing head retracts. This causes a "crash" of the dispenser, which must be reset by the operator and may result in loss of the samples contained in a tray.

Although multiwell trays molded from polyethylene or polypropylene are superior in some ways, they are likely to have residual internal stresses from the molding operation. These stresses often cause warping of the tray immediately after ejection from the mold, or may cause delayed warping or dimensional change after thermal cycling of the tray. As a result of warping of the trays, the trays' handling features for automated handling have large variations in their positions. This causes problems for automated handling equipment. In some applications, trays are stacked such that the positioning variations are compounded and the problems are greater.

Therefore, there is a need for a means for causing multiwell trays, injection molded from flexible plastic, to have the desirable qualities of rigid trays. Such a means preferably would hold the top surface of the tray planar, reduce dimensional variation of the tray, and not interfere with use of the tray.

SUMMARY OF THE INVENTION

The present invention is a rigid frame for holding a multiwell tray planar on top. By holding the tray top planar, the wells are kept parallel to each other so that a gang dispenser can be used without crashes.

In an exemplary embodiment, the multiwell tray has a rectangular tray top with wells suspended from it, a side wall projecting downward, and a flange around the base of the side wall forming a base that the tray stands on. There are apertures spaced around the side wall. The frame for holding this tray is a rectangular frame of a rigid material with low thermal expansion.

The frame has barbs spaced around its interior. When the frame is placed over the tray and pressed downward relative to the tray, the barbs snap into the apertures to retain the tray securely in the frame. Because the frame is attached at points around the perimeter of the tray, it holds the tray top planar, causing the long axes of the wells to be parallel, and perpendicular to the plane of the tray top. The frame adds weight to the tray, thus keeping it from being tipped or knocked over.

The frame remains on the tray throughout whatever processing the materials in the wells are undergoing. In the case of PCR, particularly, the process may include several thermal excursions. The frame constrains the tray from warping and keeps the outside dimensions of the tray/frame combination fairly constant. The frame includes features, such as machined indentations, that allow the frame to be manipulated by automated handlers. One aspect of the invention is that the tray can be installed in the frame in only one orientation. Index marks on the exterior of the frame indicate the orientation and can be used to allow automated handling in only one orientation, making it easier to keep track of well contents.

The invention will now be described in more particular detail with respect to the accompanying drawings in which like reference numerals refer to like parts throughout.

BRIEF DESCRIPTION OF THE DRAWINGS

FIG. 1 is a perspective view, partly exploded, of an exemplary frame and multiwell tray.

FIG. 2 is a top plan view of the tray and frame of FIG. 1, with the tray installed in the frame of the present invention.

FIG. 3 is a cross-sectional view taken on line 3—3 of FIG. 2, through the tray top, wells, and retaining means.

FIG. 4 is an enlarged perspective view of a barb 41 from upper right of FIG. 1.

DETAILED DESCRIPTION OF THE DRAWINGS

FIG. 1 is a perspective view, partly exploded, of an exemplary frame 10 and multiwell tray 80. Frame 10 generally comprises frame wall 20, having outward-facing exterior surface 30, inward-facing interior surface 40, and retaining means 25 for retaining tray 80 inside frame 10.

FIG. 2 is a top plan view of tray 80 and frame 10 of FIG. 1. FIG. 3 is a cross-sectional view taken on line 3—3 of FIG. 2, through tray top 82 and wells 91 of tray 80, and through frame 10 at retaining means 25.

Multiwell tray 80 generally comprises a plurality of wells 91 for containing chemical reactants connected by tray top 82. Tray top 82 comprises perimeter 82P, peripheral wall 85 connected to perimeter 82P and enclosing it, and retaining features 98 for engaging frame retaining means 25. In the exemplary embodiment, peripheral wall 85 extends downward from tray top 82. Wells 91, best seen in FIG. 3, include an opening surrounded by rim 92, downwardly converging walls 94, and a closed bottom 93. Each well 91 has a longitudinal axis 99.

Tray 80 is typically an injection molded one piece tray 81, made from a nonreactive, flexible plastic, such as unfilled polypropylene or polyethylene. Tray top 82 of injection-molded tray 81 is thin, flexible, and substantially planar. Peripheral wall 85 of tray 81 may be vertical, or, more typically, have a slight draft angle to allow easier removal from the mold. If there is a draft angle, the length and width of peripheral wall 85 are greater at bottom part 87B than at top part 87T.

Peripheral wall 85 includes retaining features 98, such as several apertures 86. Apertures 86 are windows removed from peripheral wall 85, exposing sections through peripheral wall 85. In the exemplary embodiment, apertures 86 are located adjacent perimeter 82P of tray top 82. Thus, each aperture 86 is not symmetrical about a horizontal axis because the top wall of aperture 86 is the bottom surface of tray top 82.

Frame 10 for holding tray top 82 planar is made of a rigid material, preferably with low thermal expansion and little potential for contaminating the contents of wells 91. Frame 10 may be machined from aluminum 6061 or similar alloy, or one of the 300 series alloys of stainless steel. Anodizing an aluminum frame 10 after machining results in a more durable, less reactive, and more decorative frame 10. It is envisioned that frame 10 could also be molded from an engineering plastic with relatively low thermal expansion, such as polycarbonate.

Since frame 10 is generally used with automated handling means, a low friction surface is desirable to minimize wear of the handling means. The cost of manufacturing frame 10, including material and labor, is preferably low, but it is not the major consideration. Because tray 81 is disposable, and frame 10 can be reused indefinitely, it is desirable to build into frame 10 any attributes that allow disposable tray 81 to be lower in cost.

Frame 10 includes retaining means 25, such as a plurality of barbs 41, which protrude from and are spaced apart on interior surface 40, for engaging apertures 86. Referring specifically to FIG. 4, an enlarged perspective view of barb 41, barb 41 comprises a flat upper ledge 42 and three radiussed sides 43 tapering left, right, and downward from upper ledge 42. Tapered sides 43 meet at a vertex 44.

Frame 10 is installed on tray 81 by lowering frame 10 over tray 81 as shown in FIG. 1. Pressure is applied to upper face 21 of frame wall 20 and to the underneath of tray 81, such as to well bottoms 93 or flange 89, or foot 90, best seen in FIG. 3. In the preferred embodiment shown, sides 43 of barb 41 deform peripheral wall 85, bowing tray top 82 slightly, allowing barb 41 to snap into aperture 86. When tray top 82 is no longer bowed, upper ledge 42 of barb 41 protrudes under bottom surface 83 of tray top 82 so as to bear on bottom surface 83 of tray top 82 and cannot be dislodged by forces encountered in normal handling of tray 81. Exemplary rectangular frame 10 preferably includes at least one barb 41 on each of its sides to ensure that tray top 82 is held rigid and planar.

Although not specifically illustrated, barbs 41 can retain tray 81 by becoming embedded in the material of perimeter 82P of tray top 82 when frame 10 is pressed downward along peripheral wall 85.

In another embodiment (not shown), retaining features 98 of tray 81 comprise a plurality of detente studs protruding upward from the periphery of tray top 82. Frame wall 20 overlaps the periphery and includes retaining means 25 comprising holes that engage the split studs.

In another embodiment (not shown), multiwell tray 81 does not comprise a peripheral wall 85 and retaining feature 98 is perimeter 82P of tray top 82. Frame wall 20 has only three sides, forming an open-ended rectangle. Interior surface 40 of frame wall 20 includes an indented channel, the same width as the thickness of tray top 82. Frame 10 is installed by sliding the channel along the edge of tray top 82. In yet another embodiment (not shown), frame 10 comprises two frame members, having a channel on interior surface 40. Each frame member slides onto an opposite end of tray top 82, then locking means connect the two frame members together.

Also, frame 20 and tray 81 are illustrated and described as being generally rectangular, but are not limited thereto. Frame 20 and tray 81 may be of any mating shapes, such as congruent shapes, including circular. Alternative arrangements of retaining means 25 and retaining features 98 are envisioned.

Frame wall 20 includes upper face 21 and bottom face 22 opposite upper face 21. In the preferred embodiment illustrated, bottom 87B of peripheral wall 85 is surrounded by an outward-projecting flange 89. Flange 89 is in turn surrounded by downward-projecting foot 90, on which tray 81 may stand. Frame 10 is adapted to fit around tray 81 such that upper face 21 of frame 10 and top surface 84 of tray top 82 are generally coplanar, and bottom face is disposed just above flange 89. With this arrangement, opposing forces applied to upper face 21 and flange 89 or foot 90 would not necessarily result in relative movement of frame 10 and tray 81. To allow relative movement such that barbs 41 and apertures 86 engage, relief slots 23 are relieved from bottom face 22 of frame wall 20 below each barb 41, best appreciated from FIG. 3. Preferably, the outside length and width of frame 10 are equal to or less than the outside length and width of flange 89 such that attaching frame 10 to tray 81 does not increase the footprint of tray 181.

It can be seen in FIG. 2 that tray top 82 has identification marks to aid well identification. Referring back to FIG. 1, multiwell tray 81 includes orientation means 96, such as corners 95, which include bevelled corner 97. Bevel 97 is a visual indication of the orientation of tray 81 and can also be used in cooperation with automated handling liquid dispensers (not shown) to maintain unique orientation in the filling process. Frame 10 includes cooperative orientation means 50, such as bevelled interior corner 52. If one of the non-bevelled corners 95 of tray 81 is inserted into bevelled corner 52, the corners will interfere and not allow tray 81 to be installed into frame 10.

Exterior surface 30 of frame wall 20 includes indexing marks 35 to indicate the orientation of tray 81. Indexing marks 35 also cooperate with the handling means of the automated equipment to allow unidirectional processing.

Exterior surface 30 further includes handling features 31, such as indentations 32, for cooperating with handling means of automated equipment. Because indentations 32 weaken frame wall 20 by removing material, indentations 32 are disposed opposite barbs 41, which project from interior surface 40. This adaptation allows frame wall 20 to not be unduly weakened by indentations 32.

Once tray 81 is installed in frame 10, tray 81 is processed. Reactants and dilutants are added to wells 91 and wells 91 can be sealed by applying a cover (not shown) over rims 92. In a typical process, tray 81 is thermal cycled by putting tray 81 and frame 10 on a heater block (not shown). The heater block typically contains an array of wells adapted to receive wells 91 of tray 81. It is desirable that frame 10 not interfere with operation of the liquid dispenser, sealer, thermal cycler, or other equipment. Frame 10 holds tray 81 throughout processing and maintains consistent outside dimensions, precise indexing, and planarity of tray top 82. After the reaction process is complete, the wells are emptied for analysis or pooling of reaction products, such as by automated liquid handler. Thus, it is important that tray 81 maintain planarity throughout the entire process, not just through initial filling.

As mentioned above, peripheral wall 85 of injection molded tray 81 typically has a draft angle, causing peripheral wall 85 to slant inward toward the top part 87B. This may result in a gap between interior surface 40 of frame wall 20 and peripheral wall 85. To compensate for this, interior surface 40 of frame 10, in a preferred embodiment, includes compression means 46, such as ridge 47, for maintaining contact between interior surface 40 and top part 87T of peripheral wall 85, resulting in a more secure hold on tray 81.

I claim:

1. In combination:

a multiwell tray, comprising:
- a plurality of wells for holding chemical reactants; and
- a thin, substantially planar tray top connecting said wells; comprising:
  - a top surface;
  - a bottom surface opposite said top surface; and
  - a perimeter; and
- a peripheral wall connected to the perimeter of said tray top and enclosing it and extending downward from said top surface of said tray top; including
  - a plurality of retaining features; and a rigid frame for holding said tray top planar; comprising:
- a frame wall; including
  - a plurality of retaining means, whereby said tray is removable retained in said frame by engaging said retaining features of said tray by said tray and said frame being moved relative to each other in a direction perpendicular to said tray top; and whereby said tray top is maintained planar such that the longitudal axes of said wells are maintained parallel.

2. In combination:

a multiwell tray, comprising:
- a plurality of wells for holding chemical reactants; and
- a thin, substantially planar tray top connecting said wells; comprising:
  - a top surface;
  - a bottom surface opposite said top surface; and
  - a perimeter; and
- a peripheral wall connected to the perimeter of said tray top and enclosing it; including:
  - retaining features; and a rigid frame for holding said tray top planar; comprising:
- a frame wall; including:
  - an inward-facing interior surface; including:
    - retaining means comprising a plurality of barbs attached to and spaced apart on said interior surface for engaging said retaining features of said peripheral wall.

3. The combination of claim 2, wherein said peripheral wall is substantially perpendicular to and extend downward from said top surface of said tray top; and said retaining features comprises a plurality of apertures of apertures in said peripheral wall.

4. The combination of claim 2, wherein said peripheral wall is substantially perpendicular to and extends downward from said top surface of said tray top; and said retaining features comprises a plurality of apertures of apertures in said peripheral wall, spaced apart on said wall and disposed adjacent said tray top, such that each said aperture is partially bounded by said bottom surface of said tray top.

5. The combination of claim 4, each said barb comprising:

tapered sides; and a flat upper ledge; wherein, upon installing said tray into said frame, said tapered sides of said barb increasingly deform one of said apertures until said flat upper ledges snaps into said aperture and contacts said bottom surface of said tray top.

6. In combination:

a multiwell tray, comprising:
- a plurality of wells for holding chemical reactants; and
- a thin, substantially planar tray top connecting said wells in an ordered array; comprising:
  - a top surface;
  - a bottom surface opposite said top surface; and
  - a perimeter; and
- a peripheral wall connected to the perimeter of said tray top and enclosing it, said peripheral wall being substantially perpendicular to and extending downward from said top surface of said tray top; including retaining features; and a rigid frame for holding said tray top planar and facilitating automated handing thereof; comprising:
- a frame wall; including:
  - an inward-facing interior surface; and
  - a plurality of barbs spaced apart on said interior surface for engaging said retaining features of said peripheral wall.

7. The combination of claim 6, said frame also comprising:

an outward-facing exterior surface; including:
- handling features for cooperating with a handling means of an automated machine.

8. The combination of claim 7, wherein said handling features comprise indentations in said exterior surface.

9. The combination of claim 6, said multiwell tray and said frame further comprising cooperative orientation means for ensuring said multiwell tray can be held by said frame in only one orientation.

10. The combination of claim 9, said exterior surface further comprising indexing marks that visually indicate the orientation of said frame and cooperate with the handling means of the machine so that said multiwell tray can be handled by the machine in only one orientation.

11. In combination:

a rectangular, injection-molded multiwell tray, comprising:
- a plurality of wells for holding chemical reactants; and
- a thin, substantially planar tray top connecting said wells into an array; comprising:
  - a top surface;
  - a bottom surface; and
  - a perimeter; and
- a peripheral wall connected to the perimeter of said tray top and enclosing it; including
  - retaining features; and a rigid rectangular frame for holding said tray top planar; comprising:
- a frame wall; including
  - an inward-facing interior surface; including
    - retaining means for removably retaining said tray in said frame by engaging said retaining features by movement in a direction substantially perpendicular to said tray top and for maintaining said tray top planar such that and the longitude axes of said wells are maintained parallel; and an outward-facing exterior surface; including:

handling features for cooperating with a handling means of an automated machine.

12. In combination:

a rectangular, injection-molded multiwell tray, comprising:

a plurality of wells for holding chemical reactants; and a thin, substantially planar tray top connecting said wells into an array; comprising:

a top surface;

a bottom surface; and a perimeter; and a peripheral wall connected to the perimeter of said tray top and enclosing it; including retaining features; and a rigid rectangular frame for holding said tray top planar; comprising:

a frame wall; including an inward-facing interior surface; including retaining means for retaining said tray in said frame by engaging said retaining features by movement in a direction substantially perpendicular to said tray top;

wherein said peripheral wall is substantially perpendicular to and extends downward from said top surface of said tray top; and said retaining features comprise a plurality of apertures in said peripheral wall.

13. The combination of claim 12, wherein said apertures are spaced apart on said peripheral wall and disposed adjacent said tray top, such that each said aperture is partially bounded by said bottom surface of said tray top.

14. The combination of claim 12, said retaining means comprising a plurality of barbs spaced apart on said interior surface of said frame wall.

15. The combination of claim 13, said retaining means comprising a plurality of barbs spaced apart on said interior surface of said frame wall, each said barb comprising:

tapered sides; and a flat upper ledge; wherein said tapered sides of said barb increasingly deform one of said apertures until said flat upper ledge snaps into said aperture and contacts said bottom surface of said tray top.

16. The combination of claim 12, said peripheral wall further comprising:

a top;

a bottom; and a draft angle such that said peripheral wall has greater length and width at said bottom than at said top; and said interior surface of said frame wall further comprising:

means for applying compressive force to said top said peripheral wall.

17. The combination of claim 11, said multiwell tray and said frame further comprising cooperative orientation means for ensuring said multiwell tray can be held by said frame in only one orientation.

18. The combination of claim 17, said exterior surface further comprising indexing marks that visually indicate the orientation of said frame and cooperate with the handling means of the machine so that said multiwell tray can be handled by the machine in only one orientation.

19. The combination of claim 12, said peripheral wall further comprising:

a flange attached to the bottom of said peripheral wall, surrounding and projecting outward from it; and said frame wall further comprising:

an upper face disposed adjacent said top surface of said tray top; and a lower face opposite said upper face;

said frame wall adapted to hold said multiwell tray with said upper face substantially coplanar with said upper surface of said tray top and said lower face disposed above said flange.

20. The combination of claim 19, said lower face including a relief slot disposed below each said aperture such that upward force applied to said flange below said barb locally moves said cooperating aperture upward for engaging said barb.

21. In combination:

a multiwell tray, comprising:

a plurality of wells for holding chemical reactants; and a thin, substantially planar tray top connecting said wells; comprising:

a top surface;

a bottom surface opposite said top surface; and a perimeter; and a rigid frame for holding said tray top planar; comprising:

a frame member; including a frame wall; including an inward-facing interior surface; including retaining means for removably retaining said tray in said frame by engaging said perimeter of said tray top such that said perimeter cannot move upward or downward and such that said tray top is maintained planar and the longitudinal axes of said wells are maintained parallel; said retaining means comprising a plurality of barbs spaced apart on said interior surface of said frame wall.

22. The combination of claim 21, said retaining means comprising a plurality of barbs spaced apart on said interior surface of said frame wall.

23. The combination of claim 1, said multiwell tray and said frame further comprising cooperative orientation means for ensuring said multiwell tray can be held by said frame in only one orientation.

* * * * *